United States Patent [19]

Hashizume

[11] Patent Number: 4,953,520

[45] Date of Patent: Sep. 4, 1990

[54] IGNITION APPARATUS OF INTERNAL COMBUSTION ENGINE

[75] Inventor: Atsushi Hashizume, Hyogo, Japan

[73] Assignee: Mitsubishi Denki Kabushiki Kaisha, Tokyo, Japan

[21] Appl. No.: 257,582

[22] Filed: Oct. 14, 1988

[30] Foreign Application Priority Data

Oct. 14, 1987 [JP] Japan ..... 62-259930
Oct. 14, 1987 [JP] Japan ..... 62-259931

[51] Int. Cl.[5] ..... F02P 11/00

[52] U.S. Cl. ..... 123/631; 123/618; 123/179 BG

[58] Field of Search ..... 123/631, 618, 179 BG, 123/603

[56] References Cited

U.S. PATENT DOCUMENTS 4,086,894 5/1978 Capurka et al. ..... 123/613

FOREIGN PATENT DOCUMENTS 58-206878 12/1983 Japan ..... 123/631

*Primary Examiner*—Andrew M. Dolinar
*Attorney, Agent, or Firm*—Sughrue, Mion, Zinn, Macpeak & Seas

[57] ABSTRACT

An ignition apparatus of an internal combustion engine includes a detecting circuit for detecting a state of the engine in which reverse rotation is taking place, and an ignition blocking circuit for blocking the generation of ignition sparks when such reverse rotation is detected. The detecting circuit comprises circuitry for measuring the duration of an output from a sensor circuit which allows current to flow in a primary winding of an ignition coil, and circuitry for detecting whether the measured time duration is longer than a predetermined time.

12 Claims, 12 Drawing Sheets

IGNITION APPARATUS OF INTERNAL COMBUSTION ENGINE

BACKGROUND OF THE INVENTION

1. Field of the Invention

The present invention relates to an ignition apparatus of an internal combustion engine wherein the generation of ignition sparks is prevented when the engine is reversely rotated.

2. Description of the Prior Art

FIG. 1 is a circuit diagram showing a conventional ignition apparatus of an internal combustion engine. In the diagram, a rotor 1 is driven by an engine (not shown) in the direction indicated by an arrow 2. The rotor 1 projects to a predetermined extent between positions A and B.

A sensor 3 is set to face the rotor 1 and detects first and second crank angle positions of the engine. The sensor 3 consists of a coil (winding), a magnet, and the like.

As shown in FIG. 2, when the front edge portion A of the projection faces the sensor 3, the sensor 3 outputs a positive voltage signal as a first angle signal. When the rear edge portion B of the projection passes in front of the sensor 3, the sensor 3 outputs a negative voltage signal as a second angle signal.

An anode of a diode 4 is connected to the output of the sensor 3 and a cathode is connected to a set input terminal S of a flip-flop circuit (hereinafter, referred to as FF) 6, respectively.

A cathode of a diode 5 is connected to the output of the sensor 3 and an anode is connected to a reset input terminal R of the FF 6, respectively.

Therefore, the sine wave of the output voltage of the sensor 3 passes through the diode 4 and is input to the set input terminal S of the FF 6, thereby setting the FF 6. The negative wave passes through the diode 5 and is input to the reset input terminal R of the FF 6, thereby resetting the FF 6.

A Q output of the FF 6 is input to a base terminal of a transistor 7 and a collector terminal is connected to a primary winding of an ignition coil 8.

The other end of the primary winding of the ignition coil 8 is connected to a (+) terminal of a battery 10 and a secondary winding is connected to the ground (the minus side potential of the battery 10) through a spark plug 9.

FIG. 3 shows an operation waveform diagram which assists in explaining the opertion of the circuit of FIG. 1. FIG. 3(*a*) shows a waveform of the output voltage of the sensor 3; FIG. 3(*b*) a waveform of the set input voltage of the FF 6; FIG. 3(*c*) a waveform of the reset input voltage of the FF 6; FIG. 3(*d*) a waveform of the Q output voltage of the FF 6; FIG. 3(*e*) a waveform of a collector voltage of the transistor 7; and FIG. 3(*f*) a waveform of a secondary output voltage of the ignition coil 8.

The operation will now be described. When the front edge portion A of the projection of the rotor 1 faces the sensor 3 due to the rotation in the direction of the arrow 2 of the rotor 1, the sensor 3 generates a positive voltage as shown in FIG. 3(*a*). A pulse such as that shown in FIG. 3(*b*) is input to the set input terminal S of the FF 6. Thus, the FF 6 is set and the output voltage at a Q output terminal of the FF 6 is set to high level as shown in FIG. 3(*d*).

Since the Q output of the FF 6 is at the high level, the transistor 7 is turned on (is made conductive) and a current flows through the primary winding of the ignition coil 8.

When the rotor 1 further rotates and the rear edge portion B of the projection passes in front of the sensor 3, the sensor 3 generates a negative voltage. Thus, a pulse as shown in FIG. 3(*c*) is input to the reset input terminal R of the FF 6 and the FF 6 is reset and the output voltage at the Q output terminal of the FF 6 is set to a low level.

Since the Q output of the FF 6 is at the low level, the transistor 7 is turned off (is made non-conductive) and the current to the primary winding of the ignition coil 8 is shut off. At this time, a high voltage as shown in FIG. 3(*f*) is generated on the secondary side of the ignition coil 8 and an ignition spark is obtained at the spark plug 9. In this manner, the above operations are periodically repeated in accordance with the rotation of the rotor 1 as shown in FIG. 3.

Since the conventional ignition apparatus of an internal combustion engine is constructed in the manner explained above, even though the operations described above involve no inconvenience, when the engine is started, the following drawbacks become apparent.

Assuming that the rotation of the rotor 1 in the direction of the arrow 2 is the forward rotation and the rotation in the direction opposite to the arrow 2 is the reverse rotation, when the rotor 1 is rotating forwardly, an output as shown in FIG. 4 is generated from the sensor 3 as explained above. In FIG. 4, $t_4$ represents the output of the sensor 3 when the front edge portion A of the projection faces the sensor 3 and $t_5$ indicates the output of the sensor 3 when the rear edge portion B faces the sensor 3.

On the other hand, when the rotor 1 is rotating reversely, the sensor 3 generates an output as shown in FIG. 5. The polarity (high or low level of the signal) of the output voltage of the sensor 3 which faces the crank angle position is opposite (in FIG. 5, $t_{4a}$ denotes the output signal of the sensor 3 when the rear edge portion B faces the sensor 3 and $t_{5a}$ indicates the output signal of the sensor 3 when the front edge portion A passes in front of the sensor 3).

Consideration will now be given to the case, where after the front edge portion A of the rotor 1 faces the sensor 3 in the forward rotation, the rotor 1 starts to reversely rotate before the rear edge portion B of the rotor 1 passes in front of the sensor 3, and the portion A passes in front of the sensor 3 during this reverse rotation. As shown in FIG. 6 [a in FIG. 6(*a*), d in FIG. 6(*b*), e in FIG. 6(*c*), and f in FIG. 6(*d*) are respectively the same as those in FIGS. 3(*a*), 3(*d*), 3(*e*), and 3(*f*)], the transistor 7 is turned on by the high level signal generated from the sensor 3 at time $t_1$ as shown in FIG. 6(*c*). The transistor 7 is turned off by the low level signal generated from the sensor 3 at time $t_2$ as shown in FIG. 6(*c*). As shown in FIG. 6(*d*), a secondary high voltage output of the ignition coil 8 is generated, and an ignition spark is thus generated by the spark plug 9.

The ignition spark generated at the front edge portion A of the rotor 1 further facilitates the reverse rotation of the rotor 1.

As mentioned above, there is a problem in that an ignition spark may be generated at the time of reverse rotation of the engine and the engine may consequently be damaged or the like.

FIG. 7 is a circuit diagram showing another conventional ignition apparatus for an internal combustion engine. In the diagram, sensor means SM detects the crank angle position of an engine (not shown). The sensor means SM generates an output signal which is changed from the high level to the low level at a first angle position $\theta_1$ synchronously with the rotation of the engine and also generates an output signal which is changed from the low level to the high level at a second angle position $\theta_2$ of the engine. This output signal is set to the low level (the first state) for the interval from the first angle position $\theta_1$ to the second angle position $\theta_2$ and is set to the high level (the second state) for the interval from the second angle position $\theta_2$ to the first angle position $\theta_1$.

The output of the sensor means SM is input to a base of a transistor 12. An emitter of the transistor 12 is connected to the ground [the (−) side potential of a battery 10]. A collector is connected to a (+) terminal of the battery 10 through a resistor 14.

A collector output of the transistor 12 is input to a base of a transistor 7. An emitter of the transistor 7 is connected to the ground. A collector is connected to the (+) terminal of the battery 10 through the primary winding of an ignition coil 8. A spark plug 9 is connected between a secondary output terminal of the ignition coil 8 and the ground.

FIG. 8 is an operation waveform diagram which will assist in explaining the operation of the apparatus shown in FIG. 7. FIG. 8(*a*) shows an output voltage of the sensor means SM. FIG. 8(*b*) shows a collector voltage of the transistor 12. FIG. 8(*c*) shows a collector voltage of the transistor 7. FIG. 8(*d*) shows a secondary output voltage of the ignition coil 8.

The operation of the prior art ignition apparatus shown in FIG. 7 will now be described. Since the first angle position $\theta_1$ of the engine is detected at time point $t_1$, the output signal of the sensor means SM is set to the low level and the transistor 12 is turned off. The transistor 7 is turned on (is made conductive) and a current therefore flows through the primary winding of the ignition coil 8.

Since the second angle position $\theta_2$ of the engine is detected at time point $t_2$, the output signal of the sensor means SM is set to the high level, the transistor 12 is turned on, and the transistor 7 is turned off (is made non-conductive). The following operation is similar to that of the prior art shown in FIG. 1.

However, assuming that the engine rotates in the reverse direction (the rotation in this case is referred to as reverse rotation) opposite to the present direction of rotation (the rotation in this case is referred to as forward rotation) of the engine at time $t_6$ before the engine arrives at the second angle position $\theta_2$, the engine passes through the first angle position $\theta_1$ at time $t_7$ in the reverse rotation state, so the output signal level of the sensor means SM is inverted from low level to high level (this operation is opposite to that which takes place in the case where, when the engine passes through the first angle position $\theta_1$ at time $t_5$ in the forward rotation state, the output signal level of the sensor means SM changes from high level to low level).

Since the output of the sensor means SM is set to the high level at time $t_7$, the transistor 12 is turned on and the transistor 7 is turned off. Consequently, the current supply to the primary winding of the ignition coil 8 is shut off at time $t_7$ and an ignition spark is generated by the spark plug 9, thereby further promoting the reverse rotation of the engine in the same way as in the prior art shown in FIG. 1.

Thus the prior art shown in FIG. 7 has the same problem as the prior art shown in FIG. 1, such as the risk of engine damage or the like.

SUMMARY OF THE INVENTION

The object of the present invention has its object the solution of the problems mentioned above, and it is an object of the invention to obtain a safe ignition apparatus for an internal combustion engine in which the generation of ignition sparks at the time of reverse rotation of the engine is prevented, thereby avoiding the risk of engine damage.

This object is achieved by the provision in an ignition apparatus for an internal combustion engine according to the present invention of a detecting circuit for detecting that the engine is in a state of reverse rotation, and ignition blocking means for blocking ignition spark generation when such a state of reverse rotation is detected. The detecting circuit comprises means for measuring the duration of an output from a sensor means which causes current to flow in a primary winding of an ignition coil, and means for detecting whether the measured duration of time is longer than a predetermined time.

DESCRIPTION OF THE PREFERRED EMBODIMENT

Figure 1:
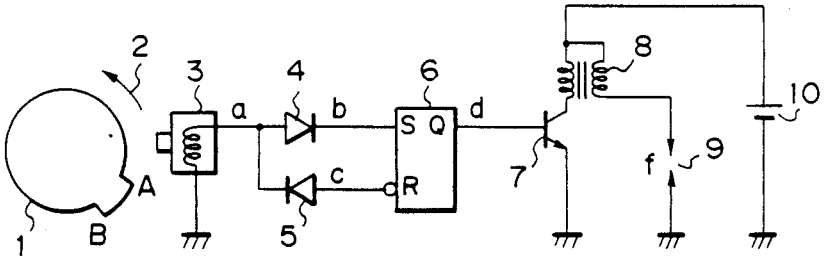
Fig. 1 PRIOR ART
FIG. 1 is a circuit diagram showing a conventional ignition apparatus of an internal combustion engine.
Figure 2:
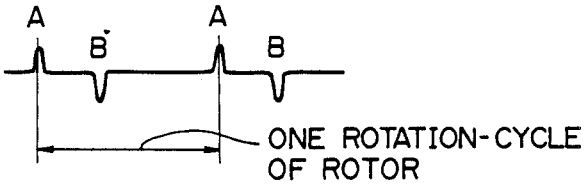
Fig. 2 PRIOR ART
FIG. 2 is a waveform diagram showing an output of a sensor for one rotation of a rotor in the ignition apparatus of the internal combustion engine shown in FIG. 1.
Figure 3:
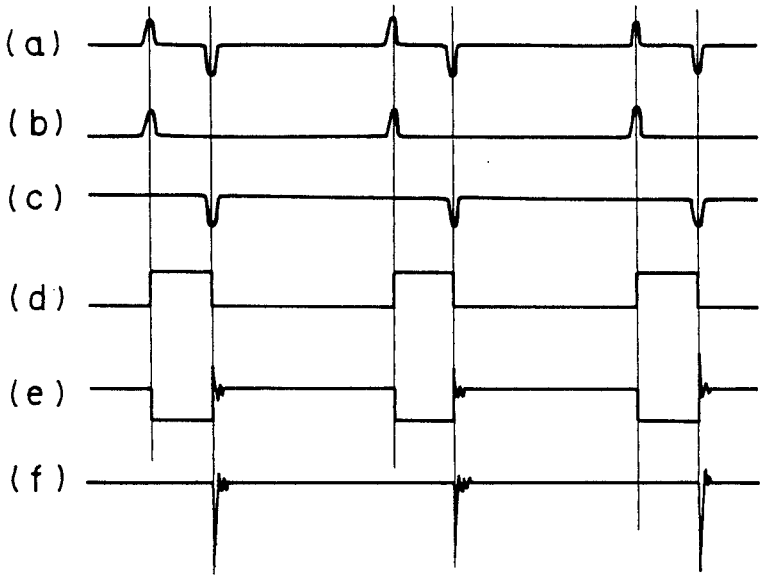
Fig. 3 PRIOR ART
FIG. 3 is an operation waveform diagram which assists in explaining the operation of the apparatus shown in FIG. 1.
Figure 7:
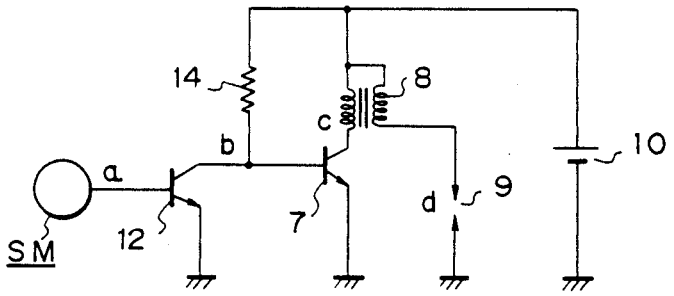
Fig. 7 PRIOR ART
FIG. 7 is a circuit diagram showing another conventional ignition apparatus of an internal combustion engine.
Figure 8:
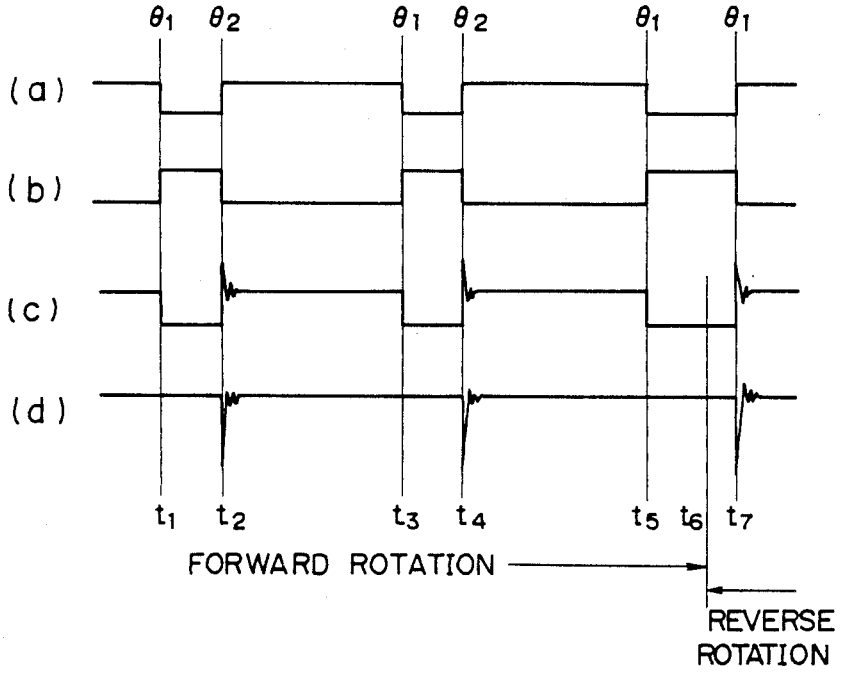
Fig. 8 PRIOR ART
FIG. 8 is a waveform diagram which assists in explaining the operation of the circuit shown in FIG. 7.
Figure 9:
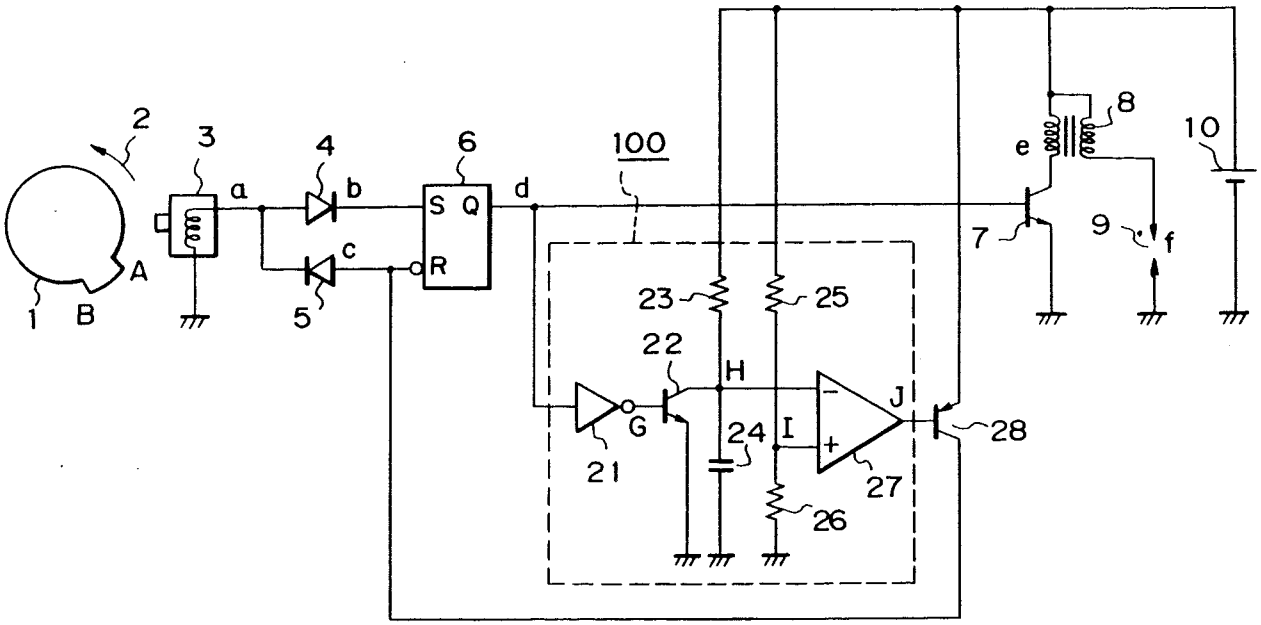
FIG. 9 is a circuit diagram showing a first ignition apparatus of an internal combustion engine according to an embodiment of the present invention.

An embodiment of the present invention will now be described with reference to the drawings. In regard to the figures, parts and components which are common to the embodiments shown in FIGS. 1 and 7 are designated by the same reference numerals and repetitive description thereof is omitted. Only those portions of the preferred embodiment which are different from FIGS. 1 and 7 will, in the main, be described below. FIG. 9 shows an embodiment for improving upon the prior art shown in FIG. 1.

In FIG. 9, the components indicated by reference numerals 1 to 10 are the same as those in FIG. 1. The components designated by reference numbers 21 and above are those which are additional to the arrangement of FIG. 1 and comprise the characteristic parts of the embodiment of FIG. 9.

In the embodiment, an inverter 21 receives the Q output of the FF 6 and inverts the phase. The output of the inverter 21 is transferred to a base of a transistor 22.

A resistor 23 is connected between a (+) terminal of the battery 10 and a collector of the transistor 22.

A capacitor 24 is connected between the collector of the transistor 22 and the ground. A time constant circuit is formed by both the resistor 23 and the capacitor 24.

Resistors 25 and 26 are serially connected between the (+) terminal of the battery 10 and the ground. The voltage at a junction (node I) between the resistors 25 and 26 is set to a predetermined level.

A (−) input terminal of a comparator 27 is connected to the collector of the transistor 22 and a (+) input terminal is connected to the node I between the resistors 25 and 26. The comparator 27 compares a charging voltage level of the capacitor 24 and the voltage level at the node I between resistors 25 and 26 and its output is inverted when the charging voltage level of the capacitor 24 is higher than the voltage level at the node I.

A detecting circuit 100 is constructed by the inverter 21, transistor 22, resistor 23, capacitor 24, resistors 25 and 26, and comparator 27.

Reference numeral 28 denotes a transistor. An emitter of the transistor 28 is connected to the (+) terminal of the battery 10, a base is connected to an output terminal of the comparator 27, and a collector is connected to the reset input terminal R of the FF 6, respectively. The transistor 28 is turned on or off in accordance with the output level of the comparator 27 and forms an inhibiting circuit for inhibiting the setting or resetting of the FF 6.

Figure 10:
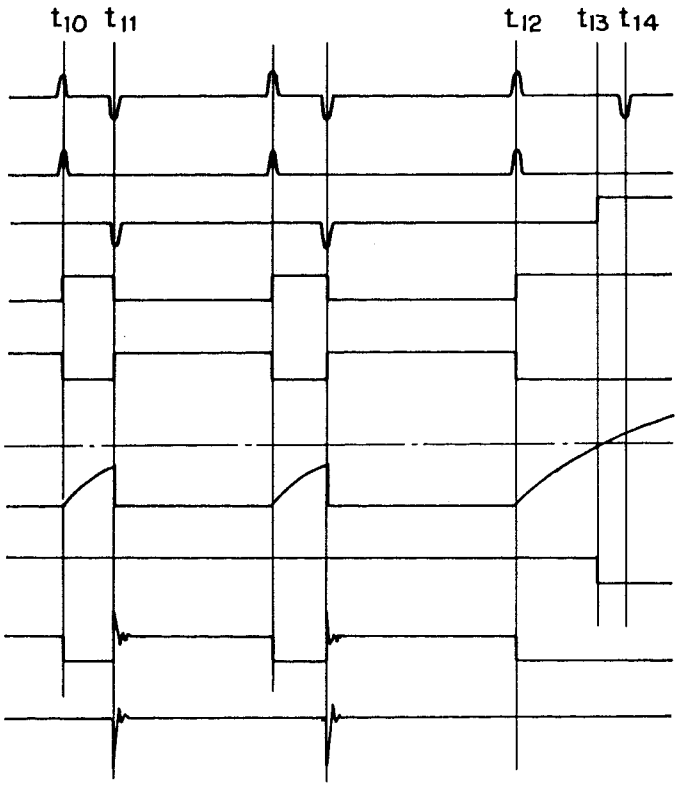
FIG. 10 is an operation waveform diagram which assists in explaining the operation of first embodiment shown in FIG. 9.

The operation will now be described. FIG. 10 is an operation waveform diagram provided to assist in explaining the operation of the circuit shown in FIG. 9. FIG. 10(*a*) to 10(*d*) show signals a to d in FIG. 9. FIGS. 10(*e*) to 10(*h*) indicate signals G, I, H, and J in FIG. 9. FIGS. 10(*i*) and 10(*j*) show signals e and f in FIG. 9.

The signal G in FIG. 10(*e*) denotes the output voltage of the inverter 21. The signal H in FIG. 10(*g*) shows the voltage at the (−) input terminal of the comparator 27. The signal I in FIG. 10(*f*) indicates the voltage at the (+) input terminal of the comparator 27. The signal J in FIG. 10(*h*) shows the output voltage of the comparator 27.

It is now assumed that the high level signal is generated from the sensor 3 at time $t_{10}$ as shown in FIG. 10(*a*). Thus, the signal b of FIG. 10(*b*) is input to the set input terminal S of the FF 6. The Q output of the FF 6 is set to a high level as shown in FIG. 10(*d*). The transistor 7 is turned on and current according to the signal e of FIG. 10(*i*) flows through the collector. Current starts flowing through the primary winding of the ignition coil 8.

On the other hand, the output G of the inverter 21 is set to a low level at time $t_{10}$ as shown in FIG. 10(*e*) and the transistor 22 is turned off. Thus, a charging current is supplied to the capacitor 24 through the resistor 23. The voltage across the terminals of the capacitor 24 starts increasing as shown in FIG. 10(*g*).

The increase in voltage of the capacitor 24 continues for the time interval between $t_{10}$ and $t_{11}$. However, since this voltage does not reach the voltage level of I in FIG. 10(*f*), the output J [FIG. 10(*h*)] of the comparator 27 is held at the high level. Consequently transistor 28 is in the OFF state.

Hence, the low level signal generated by the sensor 3 at time $t_{11}$ passes through the diode 5 and the signal c shown in FIG. 10(*c*) is input to the reset input terminal R of the FF 6, thereby resetting the FF 6. The Q output of the FF 6 is set to a low level, the transistor 7 is turned off, the primary current of the ignition coil 8 is shut off, and an ignition spark is generated by the spark plug 9.

In a manner similar to the above, the charging of the capacitor 24 is started by the high level signal generated by the sensor 3 at time $t_{12}$. When the charging voltage reaches the voltage level at the (+) input terminal of the comparator 27 at time $t_{13}$ before the next low level signal is generated by the sensor 3, the output of the comparator 27 is inverted and set to the low level. Thus, the transistor 28 in the OFF state is turned on, thereby setting the potential at the reset input terminal R of the FF 6 to the high level.

Thus, the low level output voltage is thereafter generated by the sensor 3 at time $t_{14}$. However, this output signal cannot reach the reset input terminal R of the FF 6 and the Q output of the FF 6 is held in the set state, i.e., held at the high level.

The transistor 7 which was turned on at time $t_{12}$ is therefore held in the operative mode even after time $t_{14}$. No ignition spark is generated by the spark plug 9 at time $t_{14}$.

Since the time interval from $t_{12}$ to $t_{13}$ is equal to the time that passes until the voltage across the terminals of the capacitor 24 reaches the predetermined voltage level I, a desired time duration can be set by properly selecting the capacitance value of the capacitor 24 and the resistance values of the resistors 23, 25, and 26, respectively.

On the other hand, since the rear edge portion B of the rotor 1 is located at the ignition position at the time of forward rotation of the rotor 1, this position corresponds to the crank angle of the engine during the period from the schematic compression upper dead point to about 10° before the compression upper dead point.

Figure 6:
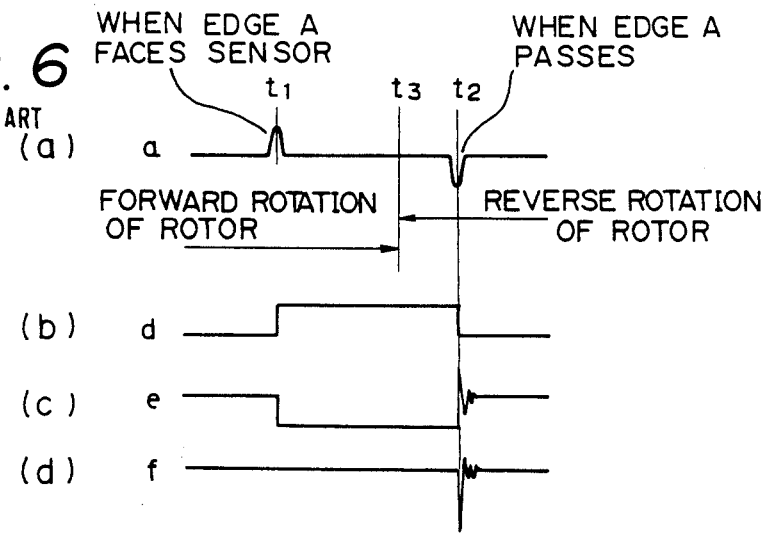
Fig. 6 PRIOR ART
FIG. 6 is an operation waveform diagram which assists in explaining a state of ignition spark generation at the time of reverse rotation of the engine in the ignition apparatus of the internal combustion engine shown in FIG. 1.

Therefore, as shown in FIG. 6, after the front edge portion A of the rotor 1 has been brought to face the sensor 3 at time $t_1$ during the forward rotation, there is a high probability of the angle position at which the rotor 1 changes from the forward rotation to the reverse rotation at time $t_3$ being near the rear edge portion B of the rotor. This is because, as the sensor approaches the rear edge portion B of the rotor 1, the compression pressure of the engine rises and the reverse torque generated by the compression pressure causes reverse rotation of the engine, and this leads to problems.

Figure 4:
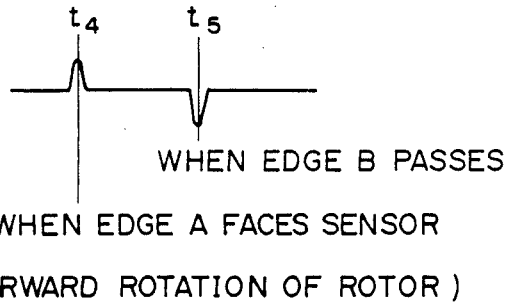
Fig. 4 PRIOR ART
FIG. 4 is a waveform diagram showing an output of the sensor at the time of forward rotation of the rotor illustrated in FIG. 1.
Figure 5:
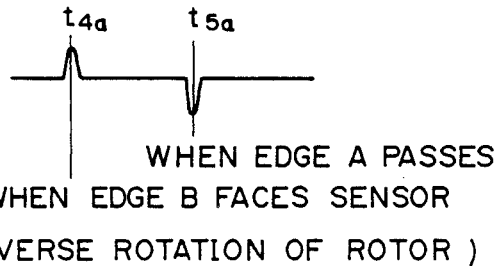
Fig. 5 PRIOR ART
FIG. 5 is a waveform diagram showing an output of the sensor at the time of reverse rotation of the rotor shown in FIG. 1.

For this reason, the time duration from $t_1$ to $t_2$ is generally made longer than that from $t_4$ to $t_5$ which is obtained by virtue of the forward rotation of the rotor 1 as shown in FIG. 4.

Consequently, the operating level of the comparator 27 can be practically set so that the comparator 27 does not operate upon forward rotation of the rotor 1 and only operates upon reverse rotation thereof.

Figure 11:
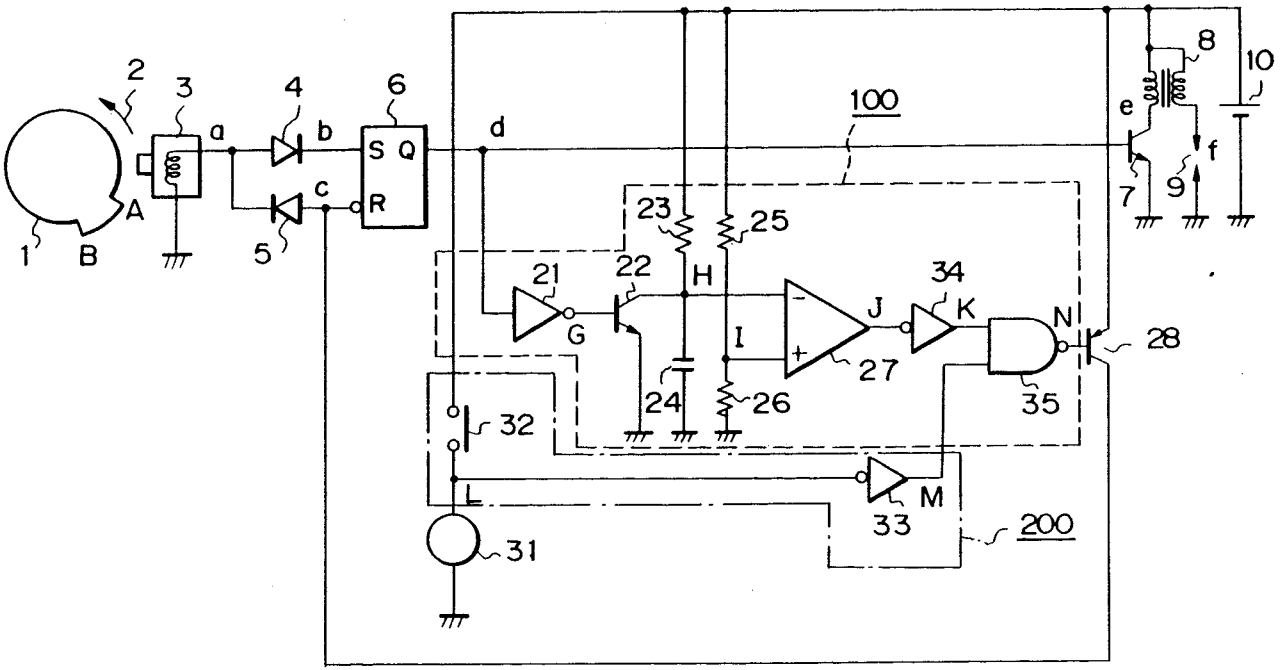
FIG. 11 is a circuit diagram showing a second embodiment of the present invention.

FIG. 11 is a circuit diagram showing the second embodiment of the invention. In FIG. 11, reference numeral 31 denotes a starter employed to start the engine (not shown); 32 indicates a switch which is connected between the starter and the (+) terminal of the battery 10 and which serves to continue the current supply to the starter; and 33 an inverter which is connected to a node between the starter 31 and the switch 32 and which generates the inverted output voltage to the input voltage. Discriminating means 200 for determining whether or not current has been supplied to the starter 31 is comprised by the switch 32 and the inverter 33.

An inverter 34 is connected to an output terminal of the comparator 27 and generates the inverted output voltage to the input voltage. A two-input NAND gate 35 is provided and the output of the inverter 34 is supplied to the first input terminal of the NAND gate 35 and the output of the inverter 33 is supplied to the second input terminal. Only when both of the input signals at the first and second input terminals are at the high level does the NAND gate 35 output a low level signal. In other cases, a high level signal is output. The output of the NAND gate 35 is supplied to a base of the transistor 28.

The other parts of the arrangement are similar to what is shown in FIG. 9 and description thereof is omitted here.

Figure 12:
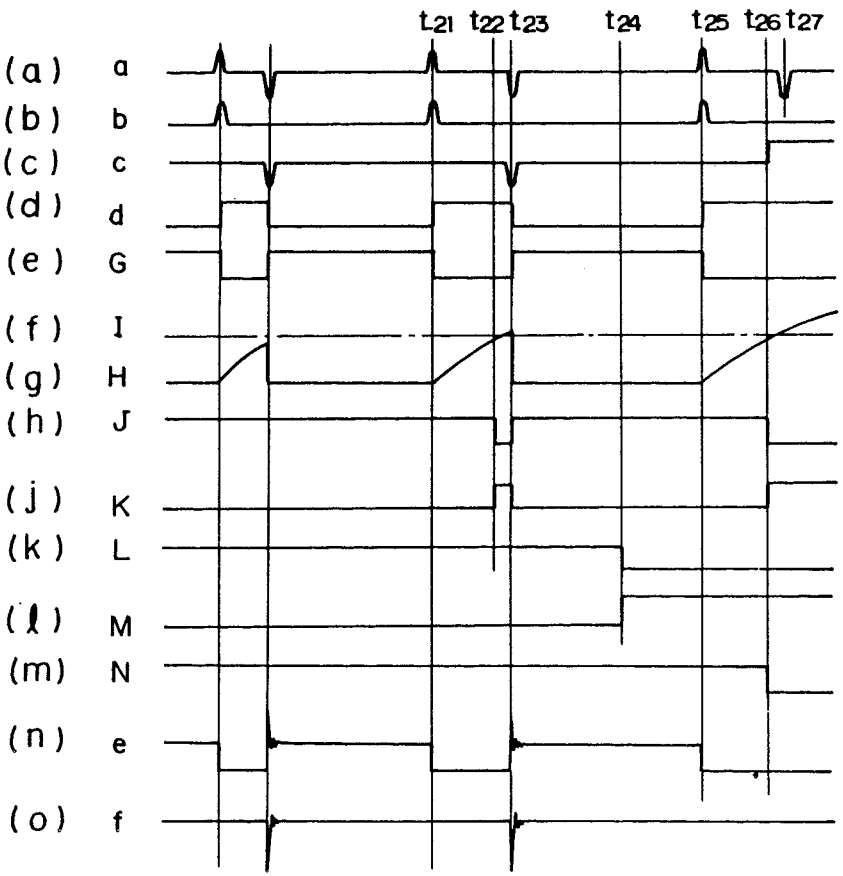
FIG. 12 is an operation waveform diagram which assists in explaining the operation of the second embodiment.

The operation of the circuit of FIG. 11 will now be described. FIG. 12 is an operation waveform diagram illustrating the operation of the circuit shown in FIG. 11. FIGS. 12(*a*) to 12(*h*) are substantially the same as FIGS. 11(*a*) to 11(*h*).

A signal K in FIG. 12(*j*) corresponds to the output voltage of the inverter 34; a signal L in FIG. 12(*k*) to the voltage across the terminals of the starter 31; a signal M in FIG. 12(*l*) to the output voltage of the inverter 33; and a signal N in FIG. 12(*m*) to the output voltage of the NAND gate 35, respectively. FIGS. 12(*n*) and 12(*o*) are the same as FIGS. 10(*i*) and 10(*j*), respectively.

It is now assumed that the voltage of the capacitor 24 starts rising from time $t_{21}$ as shown in FIG. 12(*g*) and reaches the inversion level of the comparator 27 at time $t_{22}$. At this point, the output of the comparator 27 falls from high level to low level.

Thus, the output K [FIG. 12(*j*)] of the inverter 34 is set to the high level at time $t_{22}$. However, since the switch 32 is closed at this time, the voltage L of the starter 31 is at the high level, the output M [FIG. 12(*l*)] of the inverter 33 is set to the low level, and the output N [FIG. 12(*m*)] of the NAND gate 35 is set to the high level. Hence, the output N of the NAND gate 35 is held at the high level.

Therefore, since the transistor 28 is also in the OFF state, the low level output voltage which is generated by the sensor' 3 at time $t_{23}$ is input to the reset input terminal R of the FF 6, thereby resetting the FF 6. Thus, the Q output of the FF 6 changes from high level to low level, the transistor 7 is turned off, and an ignition spark is generated by the spark plug 9.

The switch 32 is opened at time $t_{24}$, in other words, the current supply to the starter 31 is stopped. Thereafter, the charging is started from time $t_{25}$. If the voltage H of the capacitor 24 exceeds the comparison voltage level I at time $t_{26}$, the output voltage J of the comparator 27 is set to low level and the output voltage K of the inverter 34 is set to high level.

At this time, unlike the situation at time $t_{22}$, the output voltage M of the inverter 33 is also at high level, so that the input voltage levels at the first and second input terminals of the NAND gate 35 are both set to high level.

The output of the NAND gate 35 is therefore set to low level at time $t_{26}$, thereby turning on the transistor 28. The input voltage at the reset input terminal R of the FF 6 is set to high level by the switching on of the transistor 28. Therefore, the low level output signal which is generated by the sensor 3 at time $t_{27}$ does not reach the reset input terminal R of the FF 6, so that the FF 6 is held in the set state at time $t_{27}$.

Thus, no ignition spark is generated by the spark plug 9. Since driving force generated by the starter 31 is applied during the time of current supply to the starter 31, there is hardly any situation where the engine fails to pass the compression upper dead point and hence goes into reverse rotation, while when no current is supplied to the starter 31, reverse rotation of the engine occurs easily. On the basis of this fact, the embodiment of FIG. 11 is constructed so as to improve upon the embodiment of FIG. 9.

Figure 13:
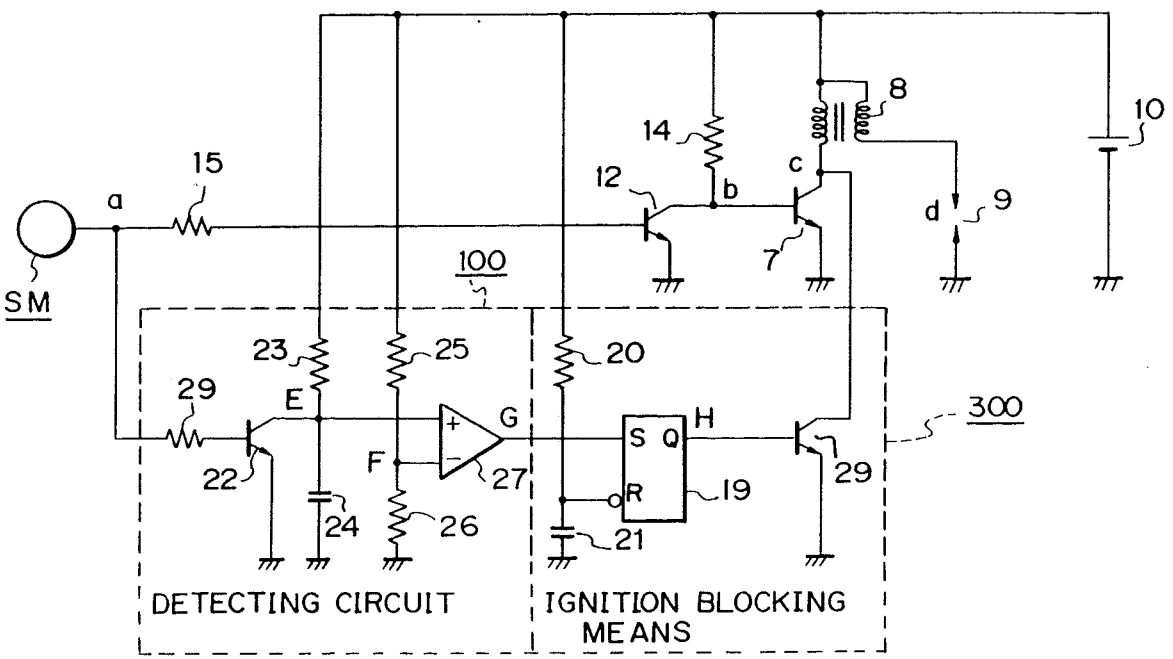
FIG. 13 is a circuit diagram showing a third embodiment of the present invention.

FIG. 13 shows a third embodiment of the invention which improves upon the prior art shown in FIG. 7.

In FIG. 13, parts and components which are the same as those shown in FIG. 7 are designated by the same reference numerals, and description thereof is omitted. Only those portions which are different from FIG. 7 will, in the main, be explained.

In FIG. 13, resistors 15 and 29 are respectively connected to the output of the sensor means SM. The resistor 15 is connected between the base of the transistor 12 and the output of the sensor means SM. The resistor 29 is connected between a base of a transistor 23 and the output of the sensor means SM. When the output of the sensor means SM is at high level, both of the transistors 12 and 22 are turned on.

The components of a detecting circuit 100 are almost the same as those of the circuit shown in FIG. 9, expect that the resistor 23 and the transistor 22 are used instead of the inverter 21.

Numeral 300 denotes an ignition blocking means. In this means, a set/reset type flip-flop circuit (hereinafter, referred to as FF) 19 is set when a set input terminal S is set to high level, and is reset when a reset input terminal R is set to low level. The set input terminal S of the FF 19 is connected to an output terminal of the comparator 27. A resistor 20 is connected between the (+) terminal of the battery 10 and the reset input terminal R of the FF 19. A capacitor 21 is connected between the reset input terminal R of the FF 19 and the ground. After a power switch (not shown) has been closed, the reset input terminal R of the FF 19 is held at low level for a predetermined period of time. After the FF 19 has been reset, the reset input terminal R of the FF 19 is set to high level.

A base of a transistor 29 is connected to a Q output of the FF 19, an emitter is connected to the ground, and a collector is connected to the collector of the transistor 7, respectively. When the Q output of the FF 19 is at high level, the transistor 29 is turned on. When it is at low level, the transistor 29 is turned off.

Figure 14:
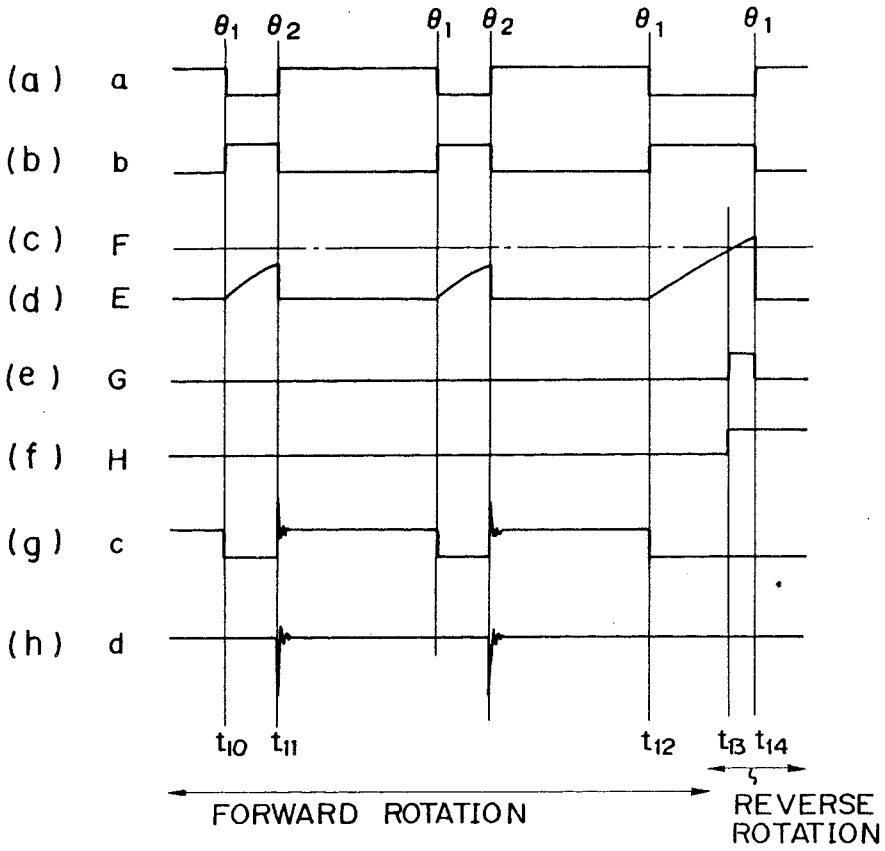
FIG. 14 shows a waveform diagram which assists in explaining the operation of the third embodiment.

The operation will now be described. FIG. 14 is a waveform diagram illustrating the operation of the above circuit. FIGS. 14(*a*) and 14(*b*) show signals a and b in FIG. 13, respectively. FIGS. 14(*c*) to 14(*f*) show signals F, E, G, and H in FIG. 13, respectively. FIGS. 14(*g*) and 14(*h*) show signals c and d in FIG. 13.

Thus, the signal E in FIG. 14(*d*) corresponds to the voltage at the (+) input terminal of the comparator 27. The signal F of FIG. 14(*c*) corresponds to the voltage at the (−) input terminal of the comparator 27. The signal G of FIG. 14(*e*) corresponds to the output voltage of the comparator 27. The signal H of FIG. 14(*f*) corresponds to the Q output voltage of the FF 19.

It is now assumed that the sensor means SM detects the first angle position $\theta_1$ at time $t_{10}$. At this time, the output of the sensor means SM is changed from high level to low level as shown in FIG. 14(*a*) whereby the transistor 12 is turned off, while the collector potential is set to high level as shown in FIG. 14(*b*) whereby the transistor 7 is turned on. Thus, the collector potential assumes the state shown in FIG. 14(*g*) and current flows through the primary winding of the ignition coil 8.

On the other hand, since the transistor 22 is also turned off at time $t_{10}$, the charging of the capacitor 24 is started, flowing from the (+) terminal of the battery 10 through the resistor 23 as shown in FIG. 14(*d*).

The sensor means SM detects the second angle position $\theta_2$ at time $t_{11}$ and the output of the sensor means SM is set to high level, so that both of the transistors 12 and 22 are turned on. At this time, since the engine has continuously been rotating in the forward direction, the time duration from time $t_{10}$ to time $t_{11}$ is relatively short. Therefore, the charging voltage of the capacitor 24 does not reach the predetermined voltage level which is determined by the resistors 25 and 26, as will be obvious from FIGS. 14(*c*) and 14(*d*).

Consequently, the output of the comparator 27 is held at the low level as shown in FIG. 14(*e*). The FF 19 maintains the reset state which was decided when the power switch (not shown) was closed before time $t_{10}$. The Q output of the FF 19 is held at the low level as shown in FIG. 14(*f*).

Thus, since the transistor 29 is held in the OFF state, by turning on the transistor 12 at time $t_{11}$, the transistor 7 is turned off and the current supply to the primary winding of the ignition coil 8 is shut off at time $t_{11}$, an ignition spark thereby being generated by the spark plug 9 as shown in FIG. 14(*h*).

Next, in the case where the engine rotation is reversed before it reaches the second angle position $\theta_2$ after the first angle position $\theta_1$ has been detected at time $t_{12}$ and the first angle position $\theta_1$ is again detected at time $t_{14}$ in the state of reverse rotation, a current first flows through the primary winding of the ignition coil 8 from time $t_{12}$ and the charging of the capacitor 24 is started in a manner similar to what happens at the time $t_{10}$.

However, since the engine rotation is reversed during the foregoing process in this case, the period of time during which the output of the sensor means SM is at the low level is long. Accordingly, the charging voltage E of the capacitor 24 finally exceeds the voltage F [FIG. 14(*c*)] at the (−) input terminal of the comparator 27 at time $t_{13}$.

Since the output of the comparator 27 is inverted to the high level at time $t_{13}$ [FIG. 14(*e*)], this inverted signal functions as a set input signal of the FF 19. The FF 19 is set and the Q output H [FIG. 14(*f*)] is set to the high level.

Since the reset input terminal R of the FF 19 is at the high level, the capacitor 24 is rapidly discharged at time $t_{14}$. Even after the output of the comparator 27 has returned to the low level, the Q output H of the FF 19 is also held at the high level.

Therefore, when the sensor means SM detects the first angle position $\theta_1$ at time $t_{14}$ during the reverse rotation, even though the transistor 7 is turned off, the current supply to the primary winding of the ignition coil 8 continues without being shut off since the transistor 22 is in the ON state from time $t_{13}$. Thus, no unnecessary ignition spark is generated by the spark plug 9.

Figure 15:
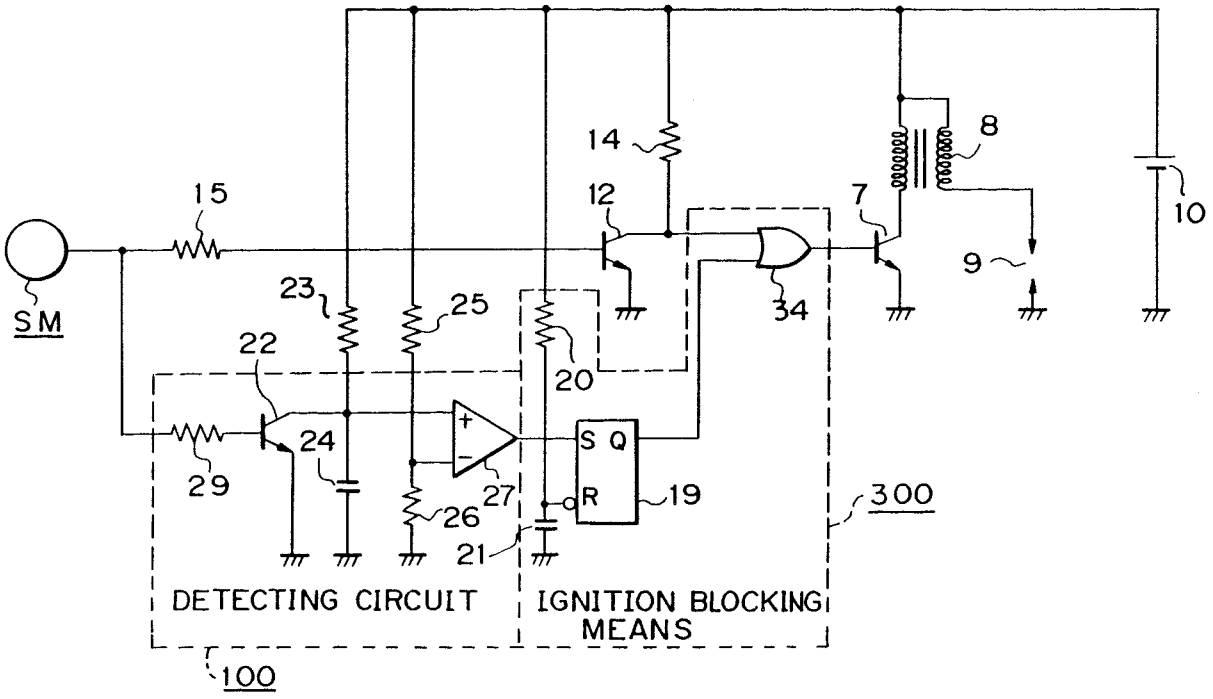
FIGS. 15 and 16 illustrate circuit diagrams corresponding to fourth and fifth embodiments of the present invention.

FIG. 15 shows a fourth embodiment of the invention which further improves upon the third embodiment and its characteristic feature is as follows. Since a transistor with a high withstanding voltage for use with high currents is needed as a transistor to be used for allowing or interrupting the supply of primary current to the ignition coil 8, the use of two transistors 7 and 29 as shown in FIG. 13 is costly. To solve this problem, the transistor 7 alone is used to allow or interrupt the supply of primary current to the ignition coil 8. Namely, an OR gate 34 is used to synthesize the signals before the transistor 5 is driven.

The OR gate 34 is of the two-input type. If either one of two input signals is at the high level, the OR gate 34 outputs a high level signal. Only when both of the input signals are at the low level does the OR gate 34 output a low level signal.

A first input terminal of the OR gate 34 is connected to the collector of the transistor 12 and a second input terminal is connected to the Q output of the FF 19. An output terminal of the OR gate 34 is connected to the base of the transistor 7. Ignition blocking means 200 is composed of the OR gate 34, the resistor 20, the capacitor 21 and FF 19.

In FIG. 15, when the Q output of the FF 19 is at the low level (before time $t_{13}$ in FIG. 14), an output of the OR gate 34 has the same phase as that of the signal at the first input terminal (when the input signal is at the high level, the output signal is also at the high level; if the input signal is at the low level, the output signal is also at the low level). Therefore, the primary current flows through the ignition coil 8 from time $t_{10}$ in FIG. 14 and the current supply is shut off at time $t_{11}$ and an ignition spark is generated.

On the other hand, after the Q output of the FF 19 has been set to the high level (after time $t_{13}$ in FIG. 14), the second input terminal of the OR gate 34 is set to the high level. Thus, even if the first input terminal is set to be either high or low level, the OR gate 34 outputs a high level signal and the transistor 7 is held in the ON state, the supply of primary current to the ignition coil 6 being left uninterrupted. Thus, no ignition spark is generated.

Figure 16:
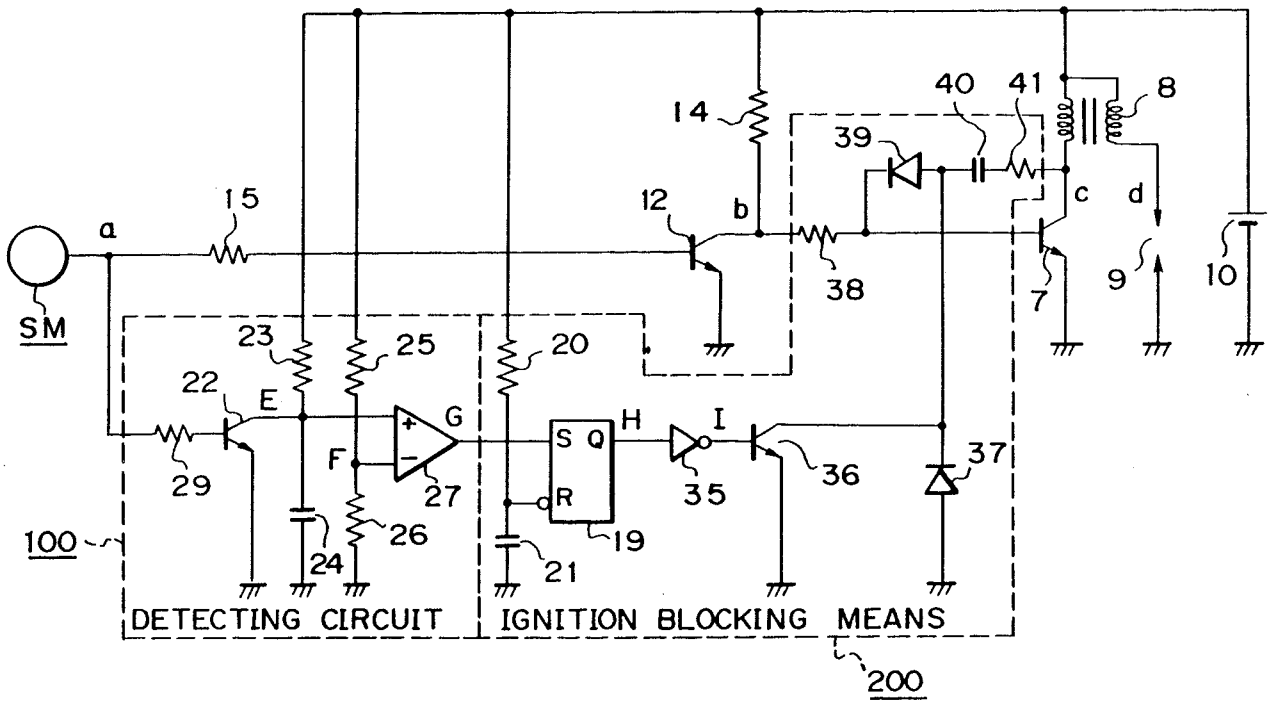

FIG. 16 is a circuit showing a fifth embodiment of the invention. An input terminal of an inverter 35 is connected to the Q output of the FF 19. The inverter 35 generates an output signal whose phase is opposite to that of the input signal. An output of the inverter 35 is input to a base of a transistor 32. An emitter of the transistor 36 is connected to the ground and a collector is connected to a cathode of a diode 37. An anode of the diode 37 is connected to the ground.

A resistor 38 is arranged between the base of the transistor 7 and the collector of the transistor 12. A resistor 41, a capacitor 40, and a diode 39 are serially connected. This serial circuit is connected between the base and collector of the transistor 7.

Namely, a negative feedback circuit is formed by the loop consisting of the collector of the transistor 7, resistor 41, capacitor 40, the anode of the diode 39, the cathode of the diode 39, and the base of the transistor 5.

On the other hand, a node of the capacitor 40 and the anode of the diode 39 is connected to a collector of the transistor 36. When the transistor 36 is turned on, the foregoing negative feedback circuit is made inoperative. When it is turned off, the negative feedback circuit is made operative.

In FIG. 16, the ignition blocking means 200 is comprised by the FF 19, resistor 20, capacitor 21, inverter 31, 35, transistor 36, diode 37, resistor 38, diode 39, capacitor 40, and resistor 41.

Figure 17:
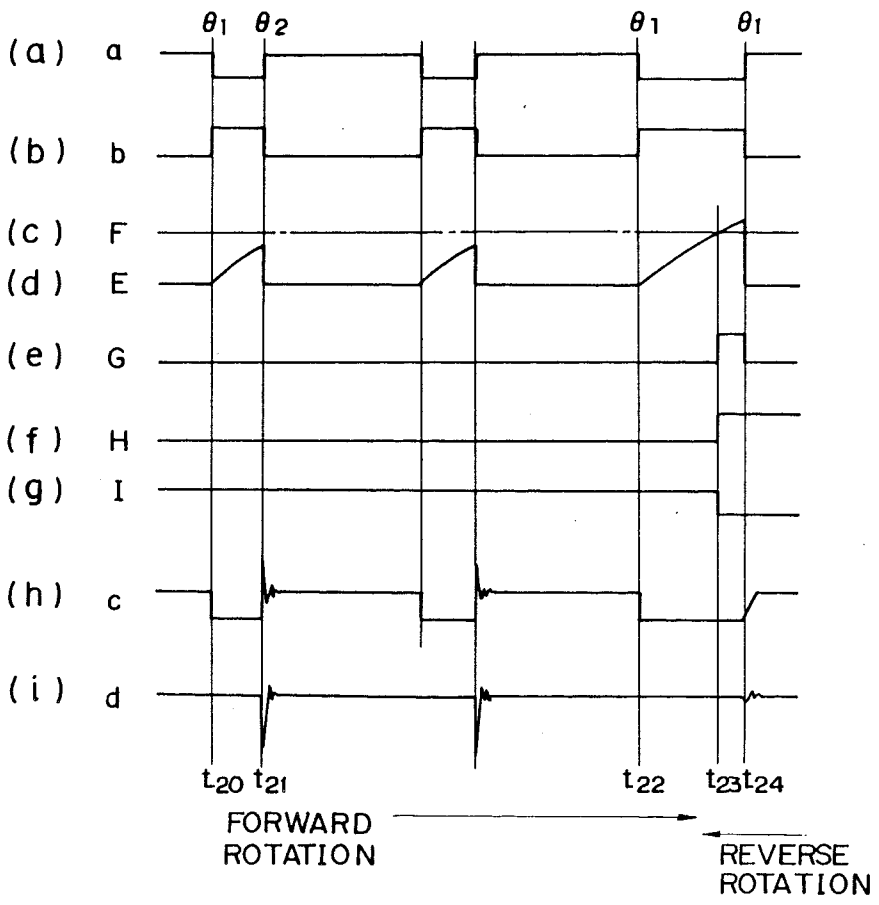
FIG. 17 is a waveform diagram which assists in explaining the operation of the fifth embodiment shown in FIG. 16.

FIG. 17 is an operation waveform diagram of the fifth embodiment circuit shown in FIG. 16. In FIG. 17(*g*) shows an output voltage of the inverter 35. FIGS. 17(*a*) to 17(*f*) are the same as FIGS. 14(*a*) to 14(*f*). FIGS. 17(*h*) and 17(*i*) are the same as FIGS. 14(*g*) and 14(*h*).

In FIG. 17, the sensor means SM detects the first angle position $\theta_1$ at time $t_{20}$ and the output of the sensor menas SM is set to the low level, so that the transistor 12 is turned off and the current flowing from the (+) terminal of the battery 10 to the resistor 14 passes through the resistor 38 and reaches the base of the transistor 7. Thus, the transistor 7 is turned on (no influence is exerted by the diode 29 because it is connected in the opposite direction).

Since the transistor 7 is turned on [FIG. 17(*h*)], the primary current flows through the ignition coil 8 and the capacitor 40 is discharged along the path consisting of the ground, diode 37, capacitor 40, resistor 41, the collector of the transistor 7, the emitter of the transistor 7, and the ground.

When the sensor means SM then detects the second angle position $\theta_2$ at time $t_{21}$ and the output of the sensor means SM is set to the high level [FIG. 17(*a*)], the transistor 12 is turned on [FIG. 17(*b*)]. Since the Q output of the FF 19 is at the low level [FIG. 17(*f*)] at time $t_{21}$, the output [FIG. 17(*g*)] of the inverter 35 is at the high level and the transistor 36 is turned on.

Therefore, when the transistor 12 is turned on and the transistor 7 is turned off, the charging current of the capacitor 40 flows along the path consisting of the (+) terminal of the battery 10, the primary winding of the ignition coil 8, resistor 41, capacitor 40, the collector of the transistor 36, and the emitter thereof, so the off state of the transistor 7 is not influenced.

Consequently, the primary current of the ignition coil 8 is shut off at time $t_{21}$ and an ignition spark is generated by the spark plug 9 [FIG. 17(*i*)].

On the other hand, when the transistor 7 is turned off and the transistor 36 is turned on, the foregoing charging circuit is formed, so that the capacitor 40 is charged with the side of the resistor 41 set to the (+) potential and the side of the diode 39 set to the (−) potential.

If the direction of engine rotation reverses before it reaches the second angle position $\theta_2$ following detection of the first angle position $\theta_1$ at time $t_{22}$, the current supply of the primary current of the ignition coil 8 is started at time $t_{22}$ and the transistor 7 is turned on at time $t_{22}$, so that the discharging of the capacitor 40 is started in a manner similar to what occurs at time $t_{20}$.

However, since at this time, the period during which the output of the sensor means SAM is at low level is long, the, Q output of the FF 19 is inverted to high level at time $t_{23}$. In response to this high level output signal, the output of the inverter 35 is also inverted to low level at time $t_{23}$ [FIG. 17(*g*)], and the transistor 36 is turned off.

When the sensor means SM detects the first angle position $\theta_1$ at time $t_{24}$ during the reverse rotation, the transistor 12 is turned on and the transistor 7 is turned off while, at the same time, the potential at the collector of the transistor 12 starts increasing. The charging of the capacitor 40 is started along the path consisting of the resistor 41, capacitor 40, diode 39, the base of the transistor 7, and the emitter thereof. This results in a base current of the transistor 7 and functions to keep the transistor 7 in the ON state. Consequently, until the capacitor 40 is completely charged, the transistor 7 is slowly turned off from the ON state at a predetermined balance point as shown in FIG. 17(*h*).

Since the transition from the ON state to the OFF state of the transistor 7 at time $t_{24}$ is slow, the shut-off speed of the primary current of the ignition coil 8 is also slow. The secondary output voltage of the ignition coil 8 is at a very low level, so no ignition spark is generated by the spark plug 9.

The invention has been described in detail with particular reference to preferred embodiments thereof, but it will be understood that variations and modifications can be effected within the spirit and scope of the invention. For example, the FF 19 (FIGS. 13, 15 and 16) may be reset at a trailing timing of the output of the sensor means SM, or the like, and the means for holding the detection output of the comparator 27 is not limited to the FF 19 since, for instance, a thyristor can also be used. In regard to FIG. 16, after the Q output of the FF 19 has been inverted by the inverter 35, the transistor 36 is driven. However, the transistor 36 can also be directly driven by the $\overline{Q}$ output of the FF 19.

The charging method of the capacitor 24 is not limited to the foregoing example; a constant current charging method may also be used. As an alternative method of measuring the time duration of the first state of the sensor means SM, it is also possible to use method of counting the number of pulses by utilizing an oscillator and a counter, or the like.

As a practical example of the sensor means SM, the following devices can be considered.

(i) A slit disk is attached such as to face a light emitting diode.

(ii) A contactless switch and a rotating rotor are combined.

(iii) A magnetic pickup and a rotating rotor are combined.

what is claimed is:

1. An agnition apparatus of an internal combustion engine comprising:

a sensor for generating first and second angle signals corresponding to first and second crank angles of the internal combustion engine;

a flip-flop circuit which is set or reset by the first angle signal of said sensor and is reset or set by the second angle signal of the sensor;

a transistor for controlling a primary current of an ignition coil on the basis of an output of said flip-flop circuit and for performing an igniting operation on the basis of the second angle signal;

a detecting circuit for detecting a state of the engine wherein reverse rotation is taking place; and a circult for inhibiting the setting or resetting of the flip-flop circuit in accordance with a detection output of said detecting circuit.

2. An ignition apparatus according to claim 1, wherein said detecting circuit comprises means for measuring the duration of a set or reset state of said flip-flop circuit and means for detecting whether this measured time duration is longer than a predetermined time.

3. An ignition apparatus according to claim 2, wherein said detecting circuit compress a capacitor which is charged or discharged in accordance with the output state of said flip-flop circuit and a comparator for comparing a charging voltage of said capacitor with a predetermined voltage level.

4. An ignition apparatus according to claim 2, wherein said detecting circuit comprises:

a capacitor which is charged or discharged in accordance with the output of said flip-flop circuit;

a comparator for comparing a charging voltage of said capacitor with a predetermined voltage level;

a starter for starting the internal combustion engine;

discriminating means for determining whether a current has been supplied to said starter or not; and a logic circuit for performing a logic process upon an output of said discriminating means and an output of said comparator.

5. An ignition apparatus according to claim 1, wherein said inhibiting circuit comprises a transistor.

6. An ignition apparatus of an internal combustin engine comprising;

sensor means whose output level is inverted and set to a first state at a first angle position of the internal combustion engine and is again inverted and set to a second state at a second angle position;

a transistor for allowing a primary winding current of an ignition coil to be supplied or shut off on the basis of an output of said sensor means;

a detecting circuit for detecting a satate of the engine wherein reverse rotation is taking place by determining that a predetermined period of time has passed after first angle position has passed said sensor means of first time, without said second angle position passing said sensor means; and ignition blocking means for blocking the generation of an ignition spark in a secondary output of said ignition coil in response to a detection output of the detecting circuit.

7. An ignition apparatus according to claim 6, wherein said detecting circuit consists of means for measuring the duration of the period during which said sensor means is in the first state and for generating a detecting output when the measured time duration is longer than a predetermined time.

8. An apparatus according to claim 7, wherein said ignition blocking means comprises:

a holding circuit which is triggered by the detection output of said detecting circuit and which holds a predetermined state even after the detection output has been extinguished; and a circuit for allowing the primary winding current of the ignition coil to be supplied in response to an output of said holding circuit.

9. An apparatus according to claim 8, wherein said circuit for allowing the primary winding current to be supplied comprises an OR gate having two input terminals each connected to an output terminal of said sensor means through an inverting means and an output terminal of said holding circuit, and an output terminal connected to the base terminal of said transistor.

10. An apparatus according to claim 7, wherein said ignition blocking means comprises:

a holding circuit which is triggered by the detection output of said detecting circuit and which holds a predetermined state enve after the detection output has been extinguished; and a circuit for slowing down the shut-off speed when said transistor shuts off the current supply in response to an output of said holding circuit, thereby suppressing a secondary output voltage of said ignition coil.

11. An apparatus according to claim 10, wherein said circuit for slowing down the shut-off speed has a resistor, a capacitor and a first diode connected in series between a collector and a base of said transistor, and a second diode for discharging the capacitor connected between an emitter of the transistor and a node between the capacitor and the first diode.

12. An ignition apparatus according to claim 6, wherein said detecting circuit comprises:

a capcitor which is charged or discharged in response to said output of said sensor means; and a comparator for comparing a charging voltage of said capacitor with a predetermined voltage level.

* * * * *